US009518440B2

(12) United States Patent
Sanchez et al.

(10) Patent No.: US 9,518,440 B2
(45) Date of Patent: Dec. 13, 2016

(54) BRIDGE PLUG WITH SELECTIVITY OPENED THROUGH PASSAGE

(71) Applicant: BAKER HUGHES INCORPORATED, Houston, TX (US)

(72) Inventors: James S. Sanchez, Tomball, TX (US); Maria A. Avalos, Houston, TX (US); Dennis M. Collins, Spring, TX (US); Jeffrey D. Kitzman, Conroe, TX (US); Jason C. Mailand, The Woodlands, TX (US); Christopher K. Elliott, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 137 days.

(21) Appl. No.: 14/248,028

(22) Filed: Apr. 8, 2014

(65) Prior Publication Data

US 2015/0285024 A1 Oct. 8, 2015

(51) Int. Cl.

| | |
|---|---|
| ***E21B 33/128*** | (2006.01) |
| ***E21B 33/129*** | (2006.01) |
| ***E21B 33/134*** | (2006.01) |
| ***E21B 34/06*** | (2006.01) |
| ***E21B 47/10*** | (2012.01) |

(52) U.S. Cl.

CPC ..... *E21B 33/128* (2013.01); *E21B 33/1291* (2013.01); *E21B 33/1294* (2013.01); *E21B 33/134* (2013.01); *E21B 34/063* (2013.01); *E21B 47/1025* (2013.01)

(58) Field of Classification Search

CPC ... E21B 33/134; E21B 33/1294; E21B 34/063

See application file for complete search history.

(56) References Cited

U.S. PATENT DOCUMENTS

| | | | | |
|---|---|---|---|---|
| 4,221,264 | A | 9/1980 | Haggard | |
| 5,479,986 | A | 1/1996 | Gano et al. | |
| 5,615,741 | A | 4/1997 | Coronado | |
| 5,709,269 | A | 1/1998 | Head | |
| 6,206,094 | B1 | 3/2001 | Smith, Jr. | |
| 6,634,428 | B2 | 10/2003 | Krauss et al. | |
| 7,845,400 | B2 | 12/2010 | Smith, Jr. et al. | |
| 8,201,634 | B2 | 6/2012 | Laurel et al. | |
| 8,276,670 | B2 | 10/2012 | Patel | |
| 2005/0028980 | A1* | 2/2005 | Page | E21B 33/035 166/285 |
| 2005/0241824 | A1* | 11/2005 | Burris, II | E21B 23/00 166/255.1 |
| 2010/0270031 | A1* | 10/2010 | Patel | E21B 33/1208 166/376 |

(Continued)

*Primary Examiner* — Shane Bomar

(74) *Attorney, Agent, or Firm* — Steve Rosenblatt

(57) ABSTRACT

A bridge plug with a selectively blocked flow passage is delivered on wireline and pumped down to the desired location and set. A casing pressure test can be performed above the bridge plug while shielding the formation below from excess pressure from the pressure test. To the extent there are producing zones below the bridge plug or adjacent injection wells that could communicate with the borehole, the plug isolates those pressures from below. After the pressure test is completed, a rupture disc is blown in a passage through the bridge plug and flow is then used to deliver completion equipment to a horizontal portion of the borehole and preferably on wireline.

17 Claims, 10 Drawing Sheets

(56) References Cited

U.S. PATENT DOCUMENTS

| | | | | |
|---|---|---|---|---|
| 2011/0048743 | A1 | 3/2011 | Stafford et al. | |
| 2012/0111566 | A1 | 5/2012 | Sherman et al. | |
| 2013/0062055 | A1* | 3/2013 | Tolman | E21B 23/00 166/250.01 |
| 2013/0240201 | A1* | 9/2013 | Frazier | E21B 33/134 166/135 |
| 2015/0129212 | A1* | 5/2015 | Noe | E21B 43/267 166/280.2 |

* cited by examiner

BRIDGE PLUG WITH SELECTIVITY OPENED THROUGH PASSAGE

FIELD OF THE INVENTION

The field of the invention is borehole isolation for pressure testing a zone while isolating pressure from the formation and more particularly where the zone tested needs to be opened for flow to facilitate placement of completion equipment particularly in a horizontal segment of a borehole.

BACKGROUND OF THE INVENTION

Situations arise where a new section of a borehole is to be perforated, fracked, acidized or stimulated or otherwise treated and produced but before that happens access to an existing formation needs to be isolated if the casing where the new completion is to take place is to be pressure tested to levels that might do damage to an existing formation below. This can happen if there is a shoe at the borehole bottom that has had displacement fluid pumped through it to displace cement into an annulus. This is called a wet shoe and is done for ease of later access to the borehole bottom when later making more hole. In other situations there may still be an intent to continue production from existing perforations that are further downhole after the new completion is concluded. In still other circumstances there may be nearby injection wells that can flow over into existing perforations and the need is to isolate the surrounding injection wells from the zone to be pressure tested.

Beyond these needs is the need to be able to start and finish the new completion as soon as possible after a successful pressure test. Since there is a high probability that the tested zone is in a horizontal section of the borehole, there will be a need to deliver completion equipment to the desired location with flow. This is because wireline is not effective to deliver tools in horizontal runs without flow. Accordingly the present invention allows for quick re-establishing of flow with a pressure sensitive member in a passage through a wireline run and set bridge plug. Once the pressure test is over above the set bridge plug and the wireline is removed, application of pressure or other techniques removes a barrier so that completion equipment can be delivered to the tested zone with flow. The bridge plug can later be milled out or left in the wellbore dependent on the application and location of the bridge plug.

Various devices have used removable barriers for other purposes such as U.S. Pat. No. 6,206,094 item 108; U.S. Pat. No. 5,615,741 item 172; U.S. Pat. No. 6,634,428 item 56; U.S. Pat. No. 4,221,264 item 64; U.S. Pat. No. 7,845,400 item 14; U.S. Pat. No. 8,201,634 item 250 and US 2012/0111566 item 20. Some designs use temporary plugs that dissolve or disintegrate as shown in U.S. Pat. No. 5,479,986; US 2011/0048743 and U.S. Pat. No. 8,276,670. These rupture disc designs do not relate to the specific application of the present invention regarding the use of pressure testing followed by a need to rapidly commence additional completion tasks. The temporary plugs made of sand that get severed or others that need to dissolve all take time to open a flow passage and some of those prior designs also left a potential debris issue in the borehole that could impede subsequent operations or cause a need for a milling operation that would invite further delay in subsequent completion work.

Those skilled in the art will better understand aspects of the present invention from a review of the description of the preferred embodiment and the associated drawings while recognizing that the full scope of the invention is to be determined from the appended claims.

SUMMARY OF THE INVENTION

A bridge plug with a selectively blocked flow passage is delivered on wireline and pumped down to the desired location and set. A casing pressure test can be run above the bridge plug while shielding the formation below from excess pressure from the pressure test. To the extent there are producing zones below the bridge plug or adjacent injection wells that could communicate with the borehole, the plug isolates those pressures from below. After the pressure test is completed, a rupture disc is blown in a passage through the bridge plug and flow is then used to deliver completion equipment to a horizontal portion of the borehole and preferably on wireline.

BRIEF DESCRIPTION OF THE DRAWINGS

FIG. 1 is a section view of a borehole before the isolation device is run in;

DETAILED DESCRIPTION OF THE PREFERRED EMBODIMENT

Figure 1:
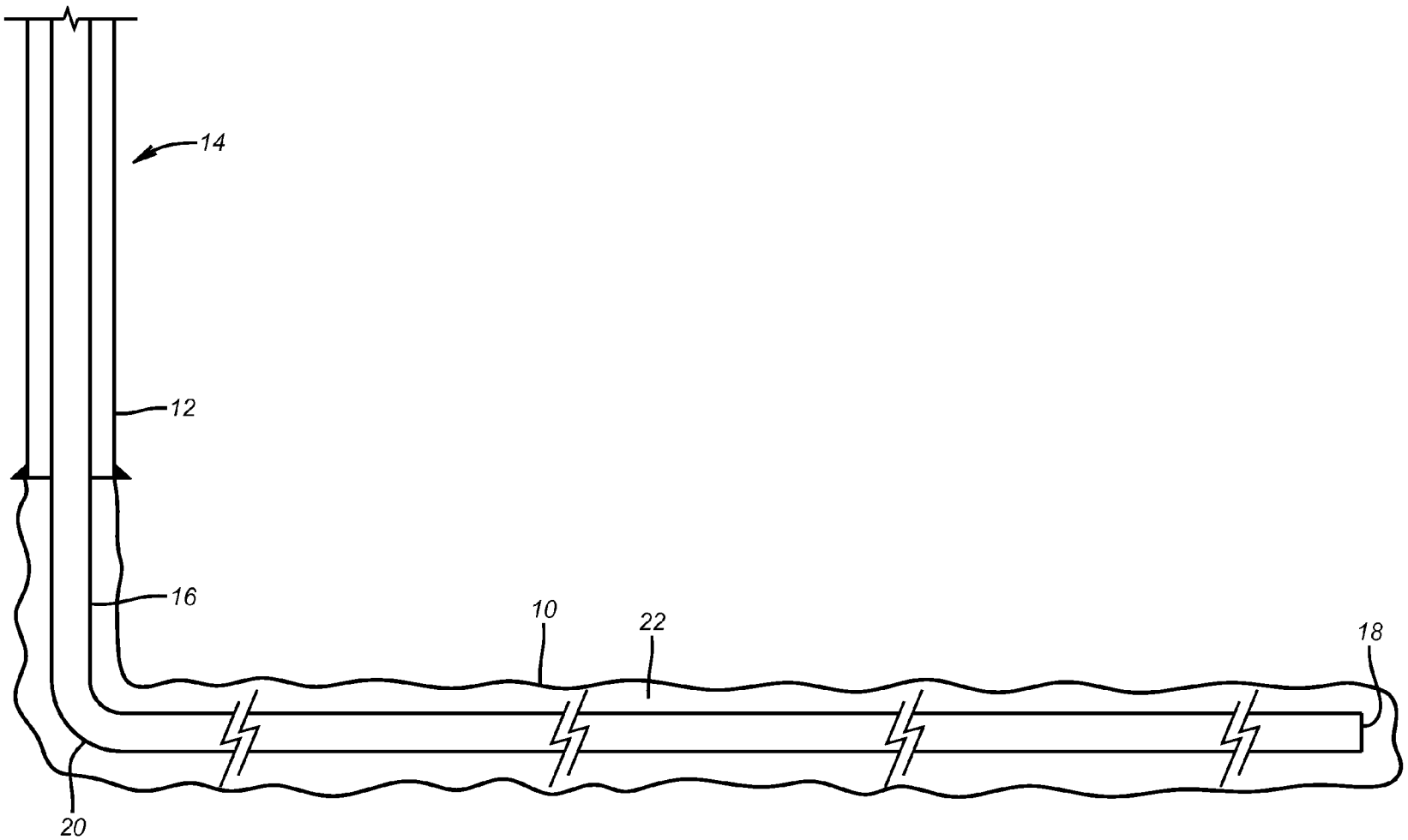

FIG. 1 shows a horizontal borehole 10 that has intermediate casing 12 in a vertical section 14. A production casing 16 extends to the horizontal portion of the borehole 10 to a toe 18 after passing the heel 20. Casing 16 is sealed with cement 22. The toe 18 can have a cement shoe that is not shown and that shoe can have displacement fluid in it that was pumped behind the cement 22. Alternatively the toe 18 can be open to lower producing zones that are not shown or to infiltration from adjacent injection wells that are also not shown.

Figure 2:
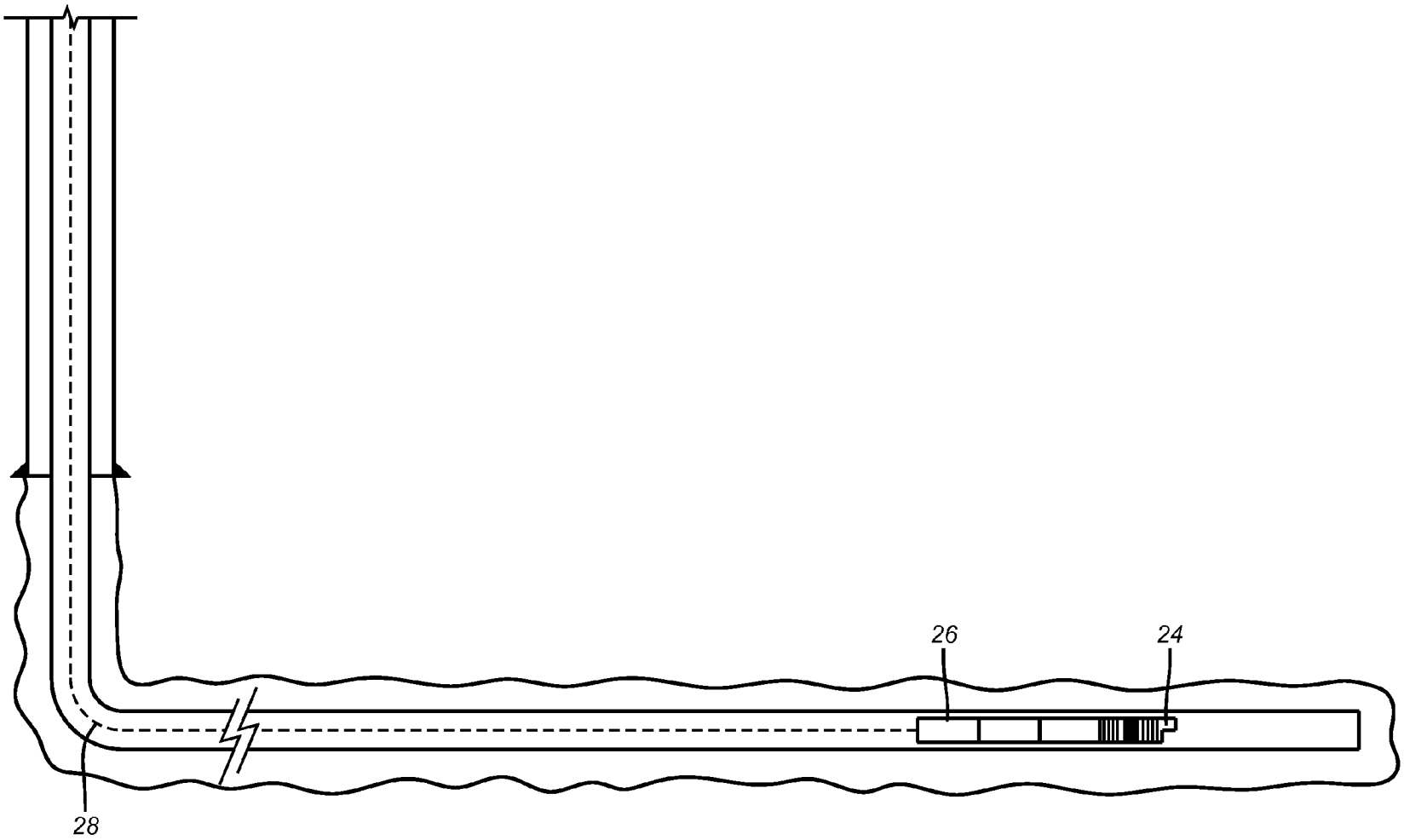
FIG. 2 is the view of FIG. 1 showing the plug run in on wireline.
Figure 2A:
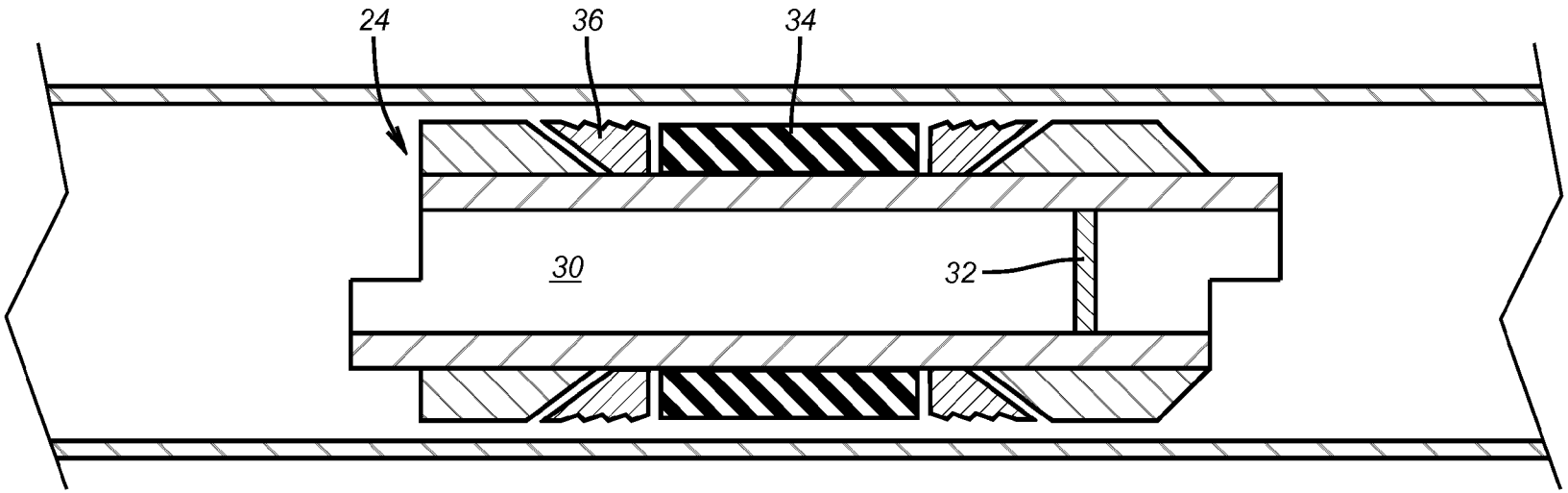
FIG. 2*a* is a detailed view of the plug shown in FIG. 2.

FIG. 2 shows running in a bridge plug 24 that preferably has a cast iron body with a setting tool 26 on wireline 28. FIG. 2*a* shows the plug 24 has a passage 30 that is blocked by a rupture disc 32. The plug 24 has a seal 34 and slips 36 and the setting tool 26 is one that is known in the art such as the Model E-4 wireline setting tool offered by Baker Hughes Incorporated.

Figure 3:
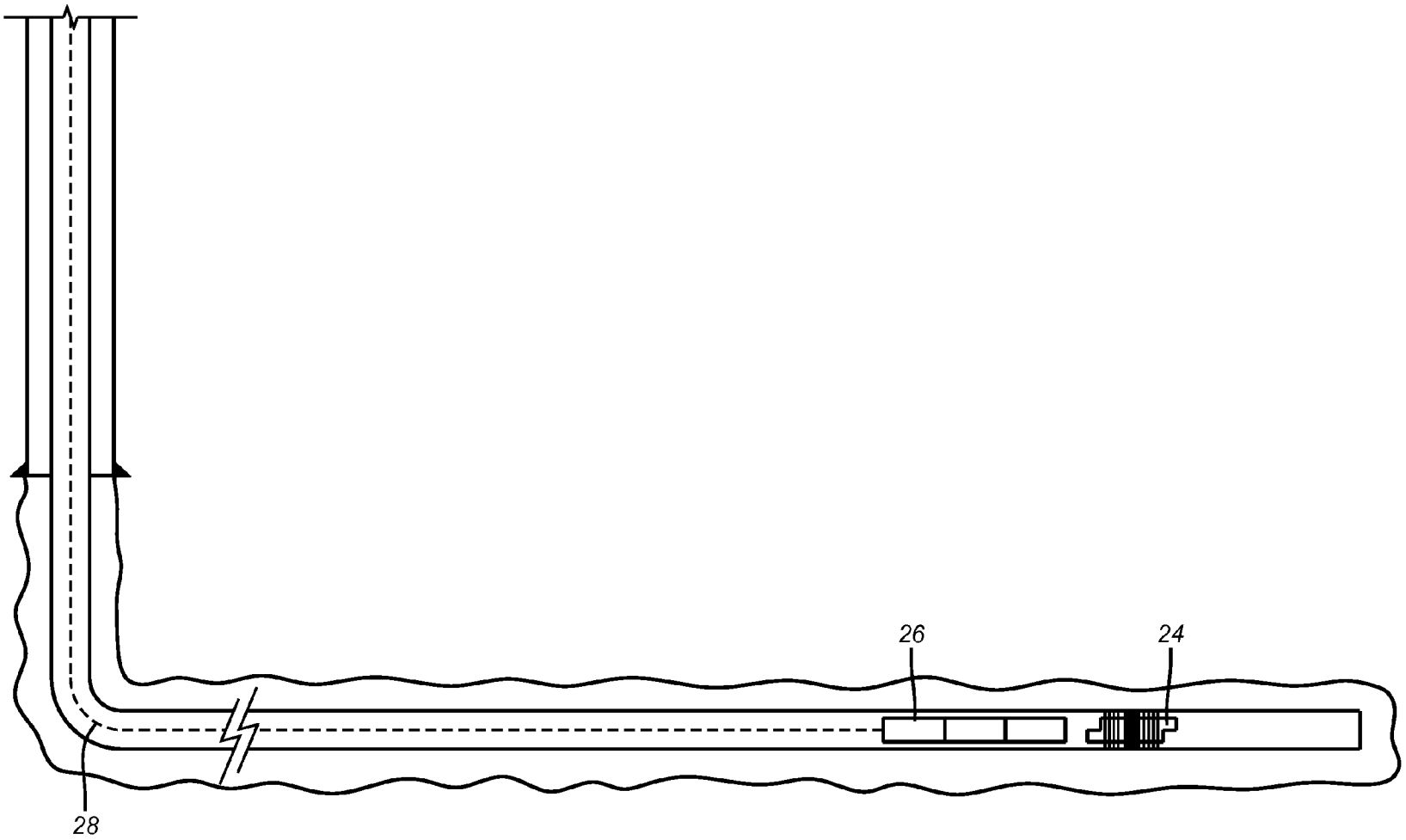
FIG. 3 is the view of FIG. 2 with the bridge plug set.
Figure 4:
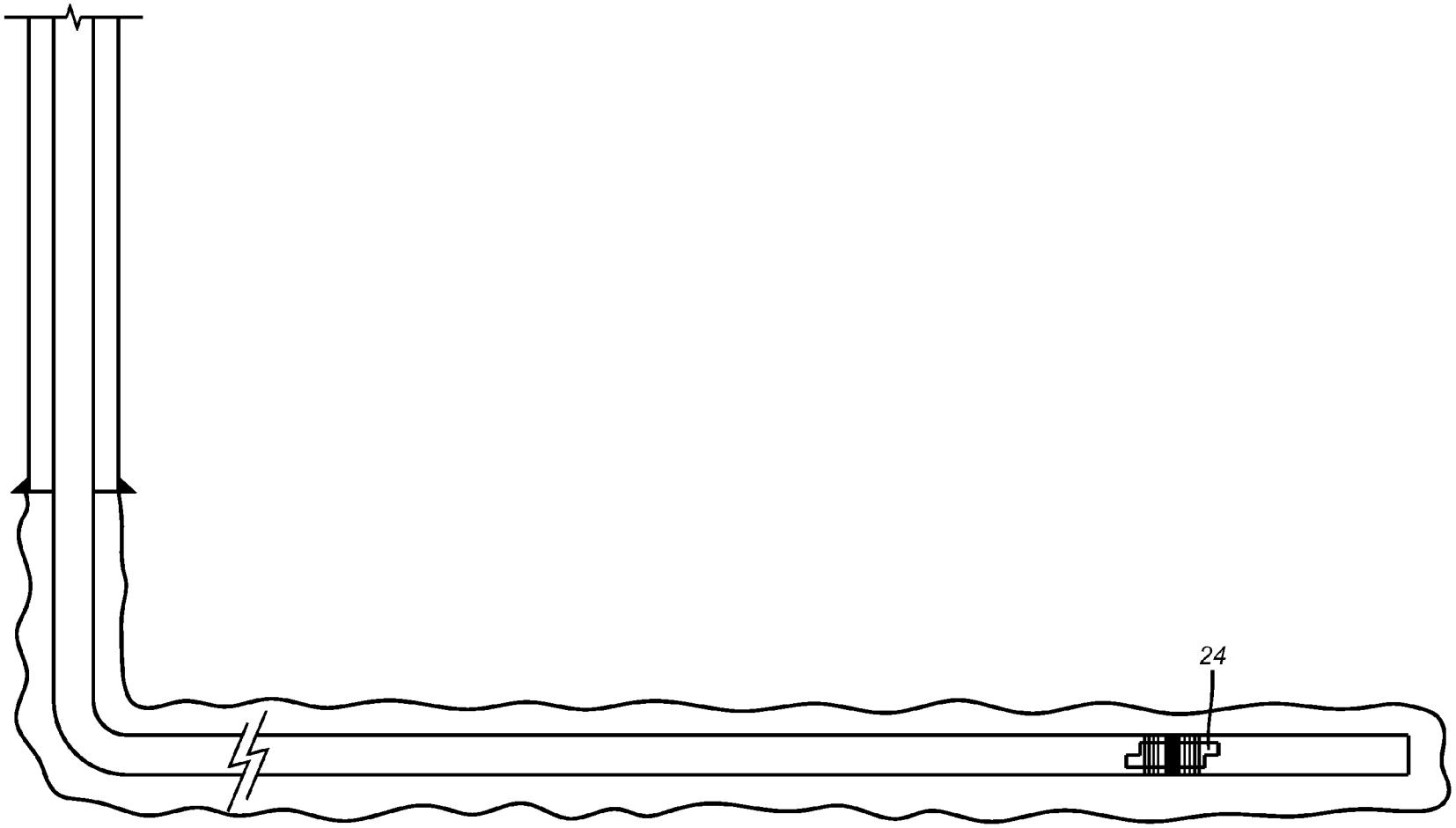
FIG. 4 is the view of FIG. 3 with the wireline removed.

In FIG. 3 the plug 24 is set where needed and the running tool 26 has separated so that it can be removed with wireline 28. FIG. 4 is the view of FIG. 3 with the wireline 28 and the setting tool 26 removed.

Figure 5:
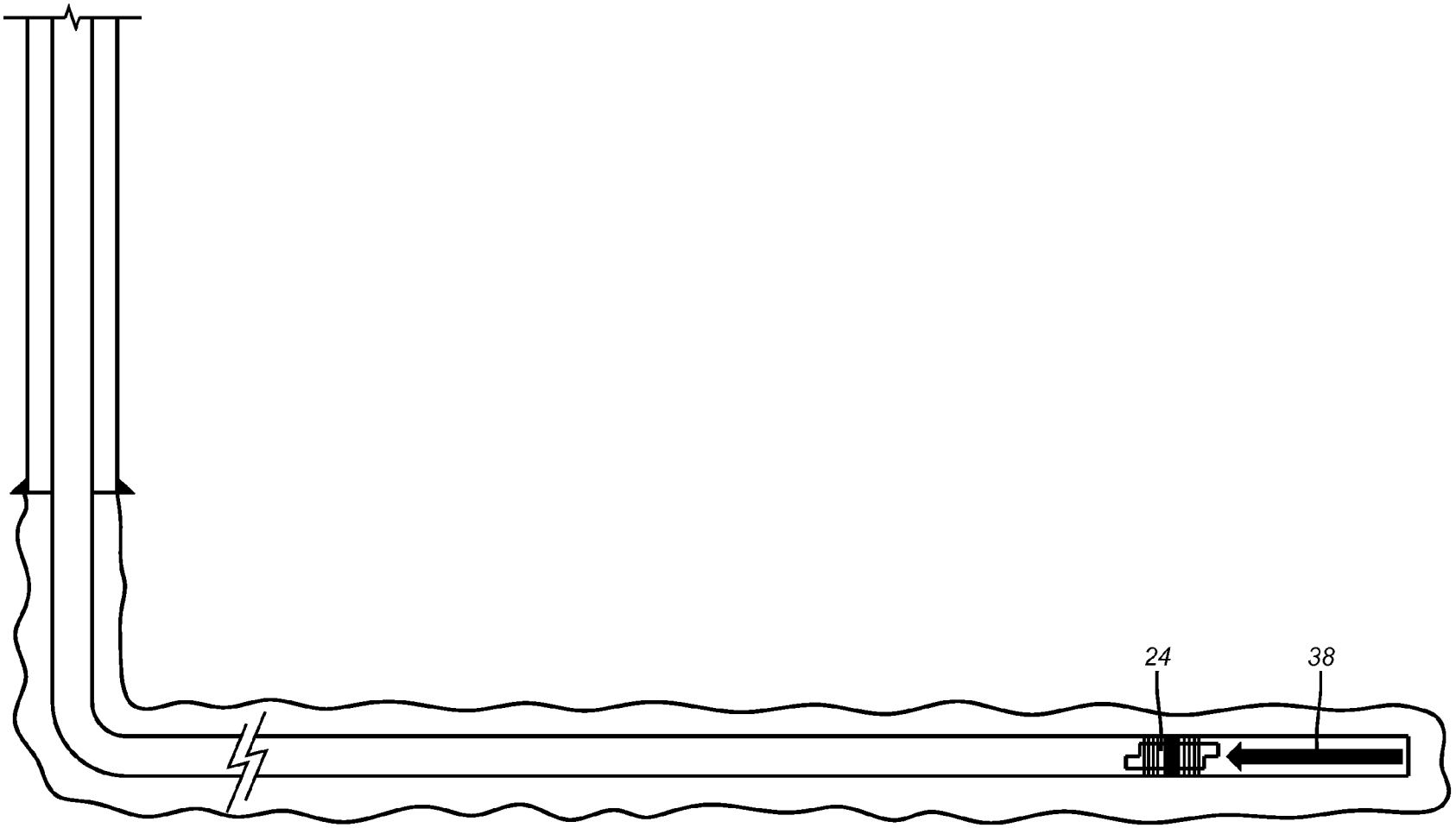
FIG. 5 is the view of FIG. 4 showing blocking pressure from below the bridge plug.

FIG. 5 shows that the set plug 24 can hold back pressures from below that are graphically represented as arrow 38. This pressure can come from active producing zones below the plug 24 or injection wells in the area that can infiltrate through producing zones that are below the plug 24.

Figure 6:
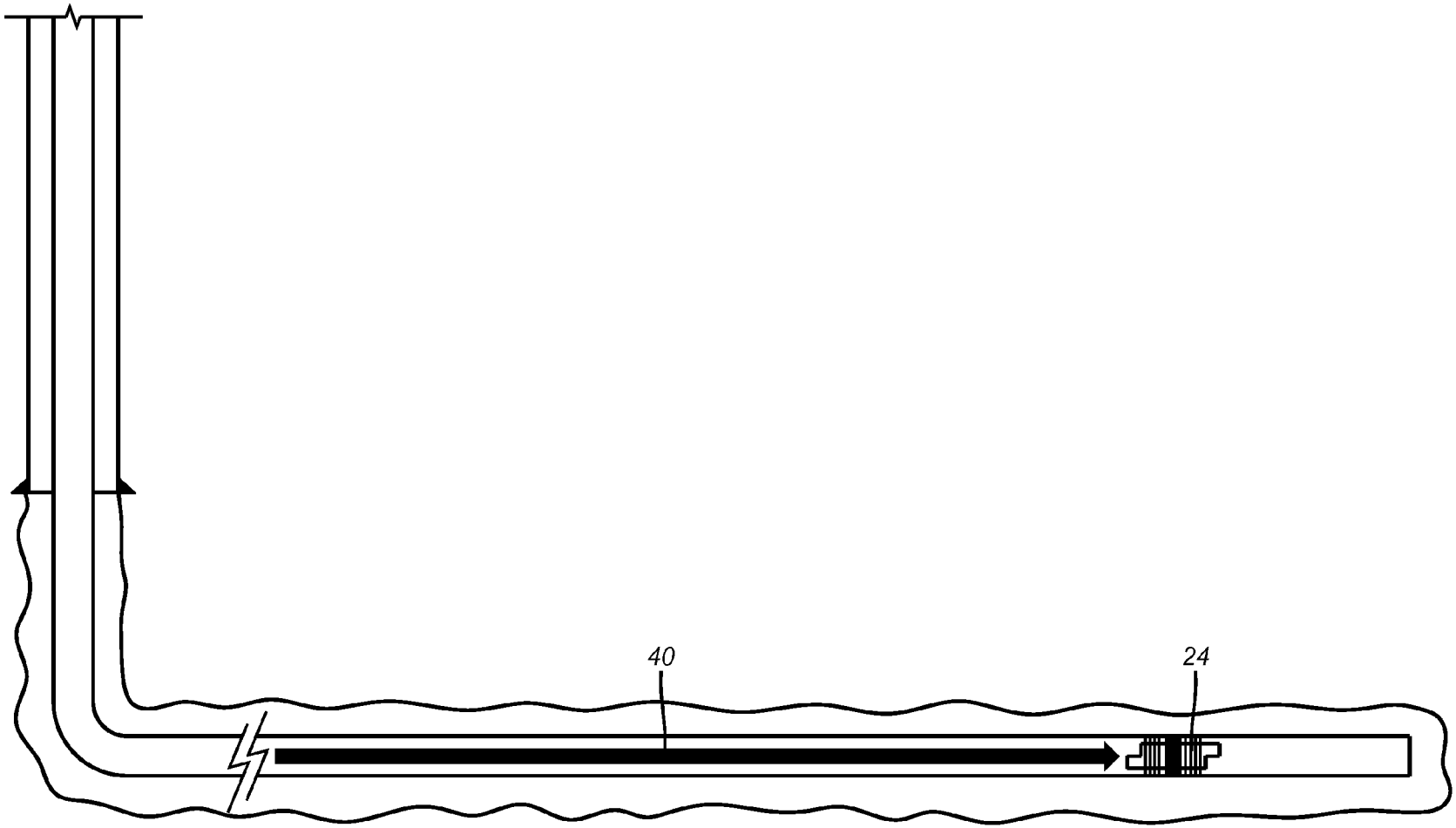
FIG. 6 is the view of FIG. 4 showing pressure retained above the bridge plug.
Figure 7:
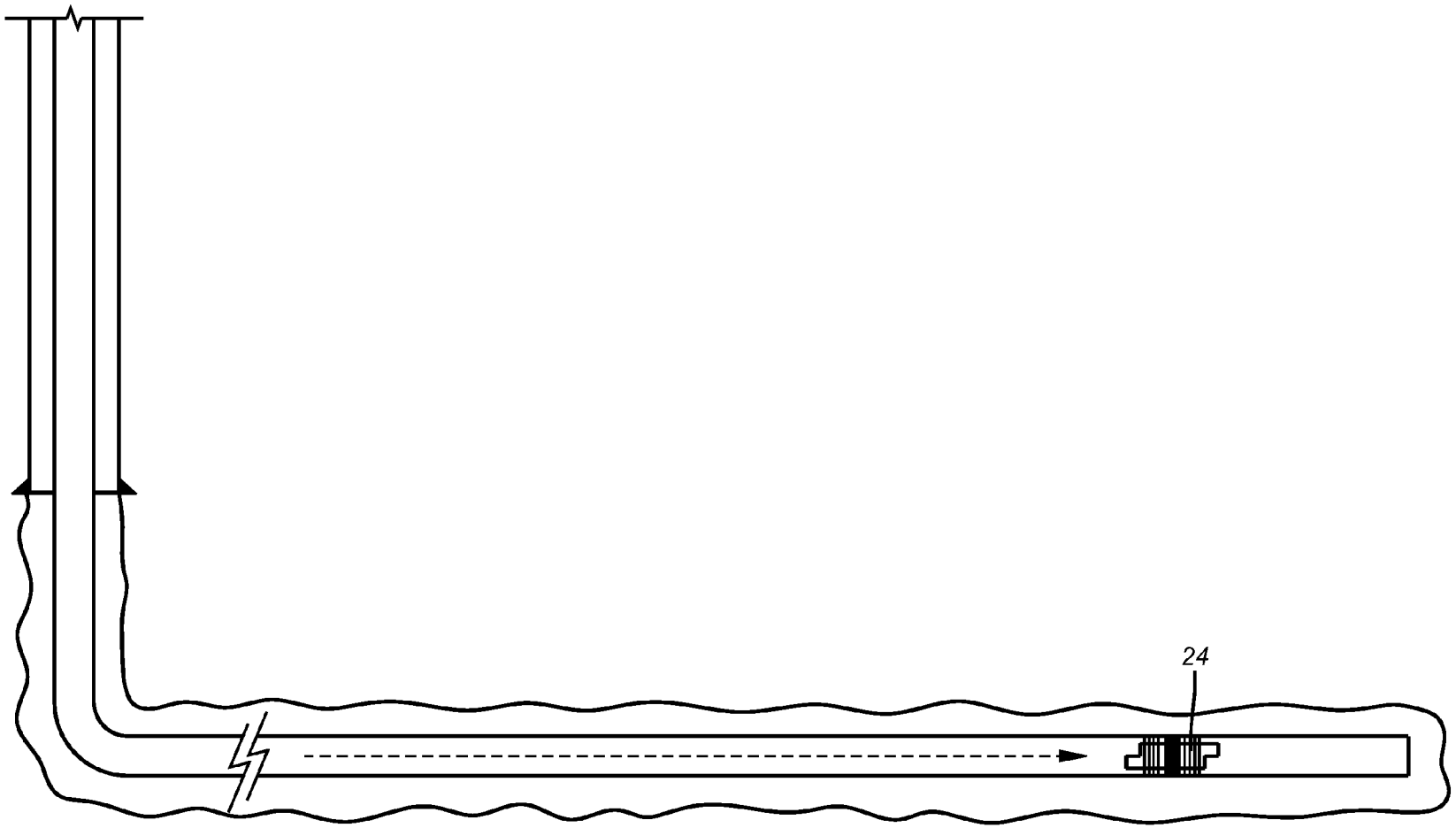
FIG. 7 is the view of FIG. 4 with the barrier in the passage of the bridge plug opened.
Figure 7A:
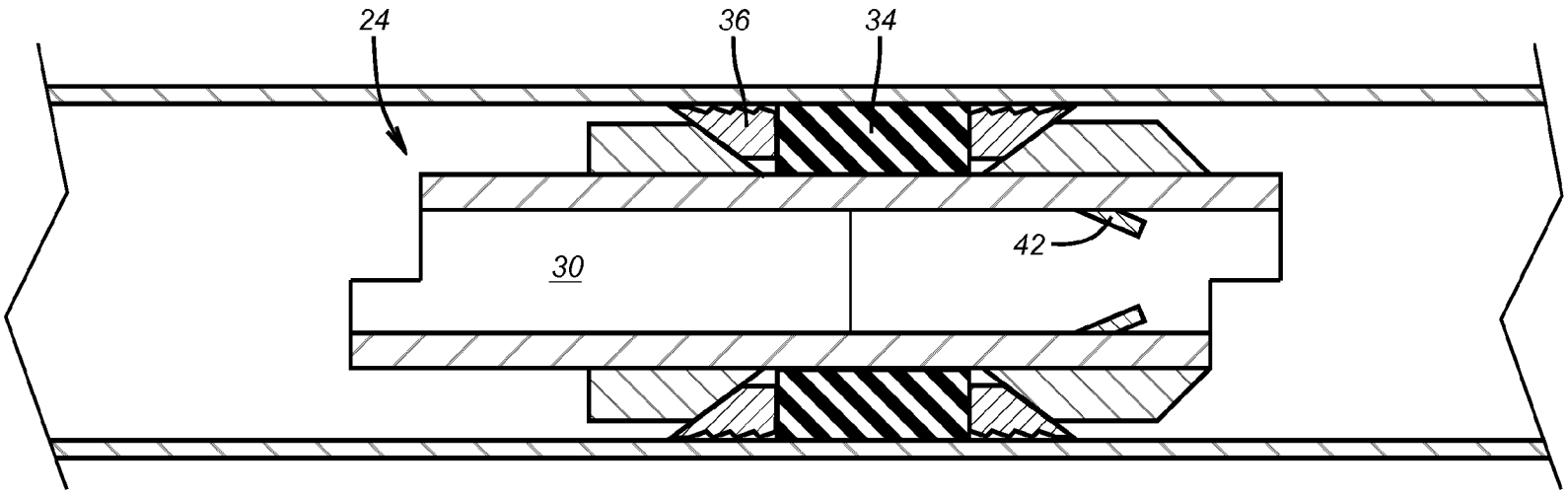
FIG. 7*a* is a detailed view of the bridge plug in FIG. 7 showing the passage through the bridge plug in the open condition.
Figure 8:
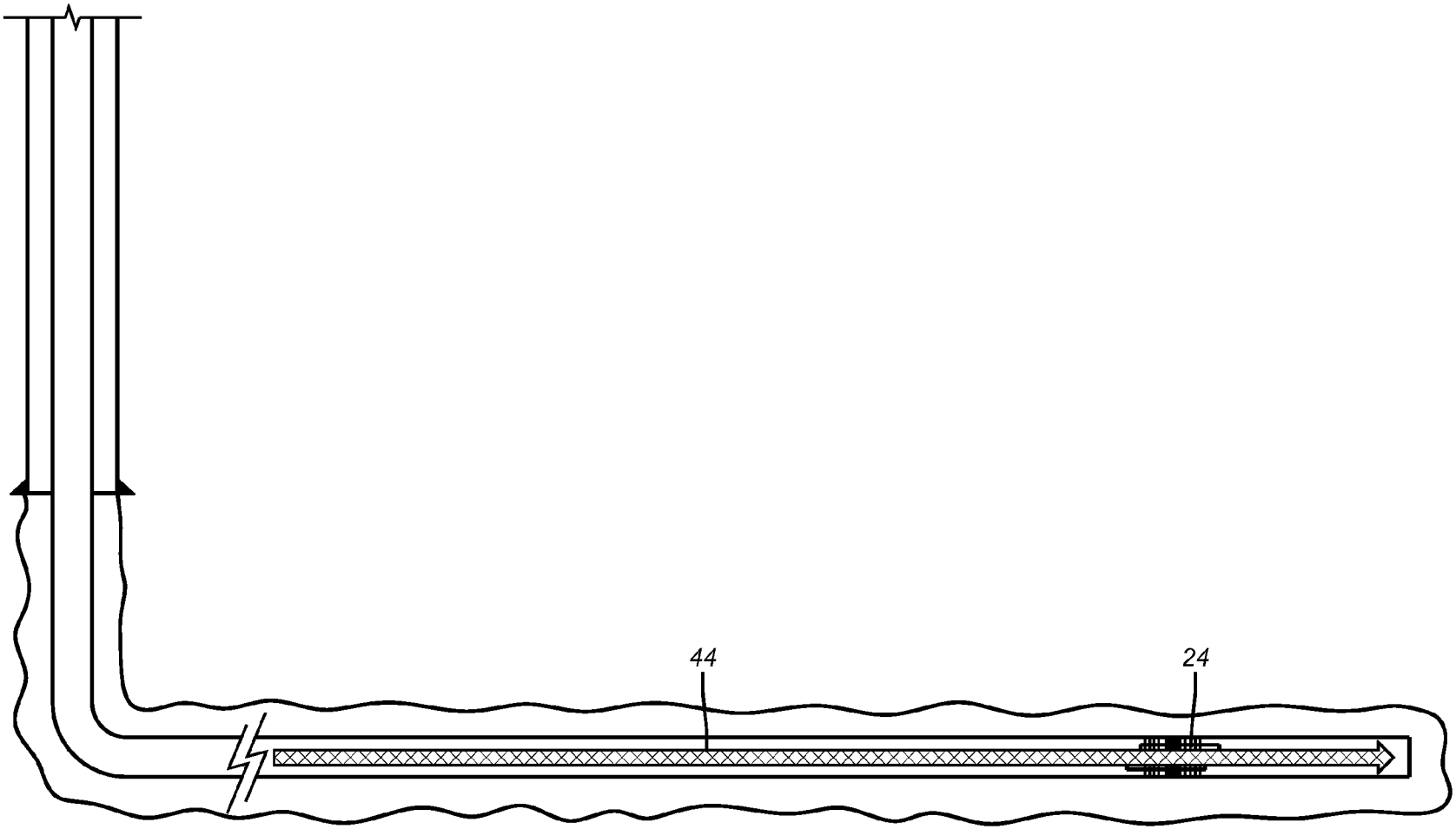
FIG. 8 is the view of FIG. 7 showing flow in aid of delivery of completion equipment after the pressure testing.

FIG. 6 illustrates the conduct of a pressure test against the set plug 24 from an uphole direction as is graphically illustrated with arrow 40. FIGS. 7 and 7*a* shows a pressure buildup to break the rupture disc 42 so that flow represented by arrow 44 in FIG. 8 can be immediately established to allow pumping down of plugs to facilitate a frack, acidizing or stimulation or other treatment job or any other tools needed for completion work in the zone above plug 24 that was previously pressure tested. The plug 24 can be ultimately milled out.

Those skilled in the art will appreciate that the present invention allows rapid deployment of a barrier on wireline by pumping to a desired location in a horizontal portion of a borehole. With the plug deployed the lower zone of the borehole is pressure isolated from an upper zone. Pressures can be applied in the upper zone for an integrity test of the casing, for example, while isolating such elevated pressure from the formation below the set plug. Pressure from nearby injection wells that can enter below the plug are also isolated. At the end of the pressure testing or other operation the passage in the plug can be opened without intervention by simply increasing pressure to the point where a barrier breaks or is otherwise removed to allow immediate resumption of flow to deliver other equipment to the horizontal portion of the borehole such as for fracking, acidizing or stimulation or other treatment. The use of pressure is preferred because of the rapid response to removal of the barrier in the passage. The barrier is also set at a desired location quickly by pumping it down.

The above description is illustrative of the preferred embodiment and many modifications may be made by those skilled in the art without departing from the invention whose scope is to be determined from the literal and equivalent scope of the claims below:

We claim:

1. A completion method, comprising:

delivering a plug on a wireline with flow into a borehole;

setting said plug at a desired location where existing formation access into the borehole is isolated on one side of said plug such that a tubular string that isolates the formation on an opposite side of said plug can be pressure tested;

initially raising pressure against an uphole side of said plug in the borehole to a first pressure to conduct a pressure test of the tubular string;

further raising pressure to a higher pressure than said first pressure to remove a barrier from a passage through said plug;

pumping fluid through said passage of the still set plug to deliver at least one tool for another operation on said uphole side of said plug.

2. The method of claim 1, comprising:

delivering a setting tool with said plug on said wireline.

3. The method of claim 1, comprising:

removing said wireline after said setting the plug.

4. The method of claim 3, comprising:

removing said wireline before said initially raising pressure against said plug.

5. The method of claim 1, comprising:

using a rupture disc as said barrier.

6. The method of claim 1, comprising:

accomplishing said removing said barrier without mechanical intervention into the borehole.

7. The method of claim 1, comprising:

performing a treatment operation after said removing said barrier.

8. The method of claim 1, comprising:

performing a casing pressure test with said initially raising pressure.

9. The method of claim 7, comprising:

milling out said plug after said treatment operation.

10. The method of claim 2, comprising:

removing said wireline after said setting the plug.

11. The method of claim 10, comprising:

removing said wireline before said initially raising pressure against said plug.

12. The method of claim 11, comprising:

using a rupture disc as said barrier.

13. The method of claim 12, comprising:

accomplishing said removing said barrier without mechanical intervention into the borehole.

14. The method of claim 13, comprising:

treating after said removing said barrier.

15. The method of claim 14, comprising:

performing a casing pressure test with said initially raising pressure.

16. The method of claim 15, comprising:

milling out said plug after said treating.

17. The method of claim 16, comprising:

making the body of said plug cast iron.

* * * * *